US010709176B2

(12) United States Patent
Maier

(10) Patent No.: US 10,709,176 B2
(45) Date of Patent: Jul. 14, 2020

(54) CYCLING SUIT WITH IMPROVED WATER BARRIER EFFECT

(71) Applicant: ASSOS OF SWITZERLAND S.A., San Pietro di Stabio (CH)

(72) Inventor: Roger Maier, Carona (CH)

(73) Assignee: ASSOS OF SWITZERLAND GMBH, San Pietro di Stabio (CH)

( * ) Notice: Subject to any disclaimer, the term of this patent is extended or adjusted under 35 U.S.C. 154(b) by 0 days.

(21) Appl. No.: 14/618,227

(22) Filed: Feb. 10, 2015

(65) Prior Publication Data

US 2015/0223528 A1 Aug. 13, 2015

(30) Foreign Application Priority Data

Feb. 12, 2014 (EP) ..... 14154774

(51) Int. Cl.
*A41D 1/084* (2018.01)
*A41D 27/14* (2006.01)

(52) U.S. Cl.
CPC ..... *A41D 1/084* (2013.01); *A41D 27/14* (2013.01)

(58) Field of Classification Search
CPC ..... A41D 1/084; A41D 1/08; A41D 13/018; Y10S 2/03
USPC ..... 2/227, 79, 2.17; 3/227, 79, 2.17
See application file for complete search history.

(56) References Cited

U.S. PATENT DOCUMENTS 1,527,825 A 2/1925 Baggerud
2,260,526 A * 10/1941 Hodovan ..... 2/228
2,571,202 A * 10/1951 Clyne ..... 2/227
3,731,319 A * 5/1973 O'Neill ..... 2/2.17
4,114,200 A * 9/1978 Smith et al. ..... 2/51
4,438,531 A * 3/1984 Long et al. ..... 2/2.15
4,608,716 A * 9/1986 Brumfield ..... 2/2.5
4,999,845 A * 3/1991 Jenks et al. ..... 2/2.16
5,282,277 A 2/1994 Onozawa
5,598,586 A * 2/1997 Munjone ..... 2/237
5,794,268 A * 8/1998 Pessey ..... A41D 1/08 2/108
5,802,609 A * 9/1998 Garofalo ..... 2/2.17
5,898,934 A * 5/1999 Hunter ..... A41D 13/012 2/2.15
6,167,571 B1 * 1/2001 Cheng ..... A41D 13/012 2/227

(Continued)

FOREIGN PATENT DOCUMENTS

FR 2498059 7/1982
FR 2509143 A1 1/1983

(Continued)

OTHER PUBLICATIONS

European Search Report in EP Application No. 14 15 4774, dated Jul. 7, 2014. (2 pages).

(Continued)

*Primary Examiner* — Richale L Quinn
(74) *Attorney, Agent, or Firm* — Fox Rothschild, LLP

(57) ABSTRACT

A cycling suit (1) has a top part (2) and a trousers portion (3) comprising leg portions (4, 5) made of a first material such as Lycra; an end section (6) of each leg portion (4, 5) of the trousers portion (3) is made of a second material such as Neoprene, which acts as a water-barrier and stops water from penetrating into shoes and overshoes under intense rain.

10 Claims, 3 Drawing Sheets

(56) References Cited

U.S. PATENT DOCUMENTS

| | | | | |
|---|---|---|---|---|
| 6,487,727 | B1 * | 12/2002 | Harsant | 2/400 |
| 7,310,824 | B2 * | 12/2007 | Walsh | 2/122 |
| 7,496,973 | B2 * | 3/2009 | Jewell et al. | 2/227 |
| 8,082,595 | B2 * | 12/2011 | Nordstrom | 2/67 |
| 8,286,262 | B2 * | 10/2012 | Rance | A41D 7/00 2/67 |
| 8,726,415 | B2 * | 5/2014 | Grilliot et al. | 2/81 |
| 8,769,724 | B2 * | 7/2014 | Semba et al. | 2/227 |
| 2002/0152531 | A1 * | 10/2002 | Fusco et al. | 2/2.15 |
| 2006/0271916 | A1 * | 11/2006 | Abe | G06F 11/0715 717/128 |
| 2006/0277645 | A1 | 12/2006 | Okajima | |
| 2008/0092273 | A1 | 4/2008 | Marshall | |
| 2008/0120759 | A1 * | 5/2008 | Tolton | 2/87 |
| 2009/0158491 | A1 * | 6/2009 | Maier | 2/78.1 |
| 2014/0130227 | A1 * | 5/2014 | Stark et al. | 2/59 |

FOREIGN PATENT DOCUMENTS

| | | | |
|---|---|---|---|
| GB | 296559 | | 9/1928 |
| GB | 2271711 | A | 4/1994 |
| GB | 2402041 | | 12/2004 |
| JP | H02292036 | A | 12/1990 |
| JP | H1161513 | A | 3/1999 |
| JP | 6311508 | B2 | 4/2018 |
| WO | 2006/027477 | A1 | 3/2006 |

OTHER PUBLICATIONS

Wiggle Ltd. "Sugoi RS ZeroPlus 320 Bib Tights", Nov. 29, 2012-Dec. 11, 2012, www.wiggle.co.uk/sugoi-rs-zeroplus-320-bib-tights/.

Wiggle Ltd., "Sugoi RS ZeroPlus 320 Bib Tights".

Latitude 45, "Sugoi RS ZeroPlus 320 Bib Tights w/Chamois", Jan. 29, 2014, https://www.latitude45.com/product/sugoi-rs-zeroplus-320-bib-tights-w-chamois-131509-1.htm.

Nalini, (www.nalini.com <http://www.nalini.com>) 2005 catalogue.

Nalini, (www.nalini.com <http://www.nalini.com>) 2005 catalogue sample.

Active Wear Bike Velocity 2014 catalogue.

* cited by examiner

CYCLING SUIT WITH IMPROVED WATER BARRIER EFFECT

CROSS REFERENCE TO RELATED APPLICATIONS

This U.S. application claims priority to European Application No.: 14154774.5, filed Feb. 12, 2014, entitled "A CYCLING SUIT WITH IMPROVED BARRIER EFFECT" the entirety of which is incorporated herein by reference.

FIELD OF THE INVENTION

The invention relates to the field of cycling suits including a trousers portion.

PRIOR ART

Various embodiments of cycling suits are known in the art. For example EP 2 071 966 discloses a cycling sport garment with a top portion and a trousers portion; EP 2 111 767 discloses a cycling suit comprising leg openings with an elastic rim band.

Riding in heavy rain, the user's feet are exposed to rain and water sprayed by the front wheel. The most common practice to insulate and protect feet from water is to wear overshoes that fit over the shoes and provide a further protection against rain and water sprays. Overshoes are made of a waterproof material and have a suitable seal around the ankle, for example a Velcro strip.

However, the experience shows that sooner or later the water penetrates and feet get cold and wet. The current approach to this problem is to use taller overshoes and focus on the ankle seal. These solutions however are not satisfactory and the problem remains unresolved yet.

SUMMARY OF THE INVENTION

The Applicant has Found that One Reason of the Above Penetration of Water is the Following.

Under heavy rain, the trousers tend to absorb water and become saturated. In such a condition (i.e. when the fabric material of the trousers is practically soaked of water), water may travel through the material of the trousers and reach a direct contact with the user's feet. Since the trousers are inserted in the shoes and overshoes, they act as a water-conducting means to bypass the protection of the overshoes. This water flowing through the trousers may be referred to as water slip.

In other words, no matter how the overshoes are waterproof and how good is the ankle seal, said water slip is able to reach directly the feet of the user and introduce discomfort. So far, the prior art was focused on the sealing between the trousers and the shoes or overshoes, as the case may be, but even the best ankle seal is bypassed by the above defined water slip. Hence, the current equipment are not satisfactory under heavy rain conditions.

Having recognized this problem, the idea underlying the invention is to avoid said water slip by making the lower portion of the trousers with a suitable barrier material.

Hence the invention provides a cycling garment including at least a trousers portion forming a pair of trousers, characterized in that said trousers portion is made of at least partially of a first material and in that an end section of each leg of the trousers portion is made of a second material other than said first material, and said second material being a water-barrier material.

Preferably the first material is an elastic fabric material.

Said second material is suitable to stop water travelling through the leg portions, thus providing a water barrier. It is preferably a water-proof synthetic rubber. A particularly preferred second material is polychloroprene which is also known as Neoprene.

The water-proof end section is extended in the lower part of the respective leg portion. Preferably said end section extends for at least 5 cm from the lower end aperture of the leg portion; more preferably between 5 and 25 cm from said lower end aperture and even more preferably 10 to 20 cm.

Preferably the end section is extended all around the ankle.

In a preferred embodiment, the height of the end section made of the second material, measured from the bottom aperture of the leg portions, is greater on the inner side of each leg portions than in the corresponding outer side. The inner side of a leg portion is understood as the side facing the other leg portion, when the suit is properly worn. The related advantage is a better protection from water sprays generated by the front wheel.

More preferably, said end section is truncated by a tilted plane relative to a longitudinal axis of the leg portion. The leg portion may be regarded as a tube (a cylindrical or substantially cylindrical surface); accordingly, the water-proof end portion is substantially a cylindrical segment. More in detail, said end portion has the shape of a truncated cylindrical surface, the plane of truncation being inclined relative to the longitudinal axis of the leg portion.

The term of cycling suit shall be understood with reference to a piece of garment suitable for cycling and having at least a pair of trousers. Preferably a cycling suit which embodies the invention is designed for cold and rainy weather and is an integral suit having a top part and a bottom part formed as a pair of trousers. Preferably the top part is integrally formed with the trousers portion. According to some of the embodiments of the invention, the top part may include a pair of shoulder straps or may be formed as a jacket.

The trousers portion and, if provided, the top part, may comprise parts of different materials, for example with a wind-shield effect or having a different breathability. For example, the leg portions may parts of a different material which are strategically located to optimally shield or protect certain body parts. For example the leg portions may include a knee portion made of a more protective and robust material, since the knee portion is generally more stressed during the use.

The advantage of the invention is that the above described water slip is prevented by the water-barrier lower end portion of trousers. Wearing a suitable pair of shoes and preferably of overshoes, a suit according to the invention provides good and reliable protection of feet from rain and water sprays. The first material is chosen with the aim of comfort and adaptation to the body. The second water barrier material is provided only in the crucial region of the ankles, while the rest of the trousers portion is made of the more comfortable first material, to provide the best possible compromise between comfort, elasticity and water tightness.

The features and the advantages of the invention will be further elucidated with the help of the following detailed description, which is given for indicative and not limiting purpose.

DETAILED DESCRIPTION

Figure 1:
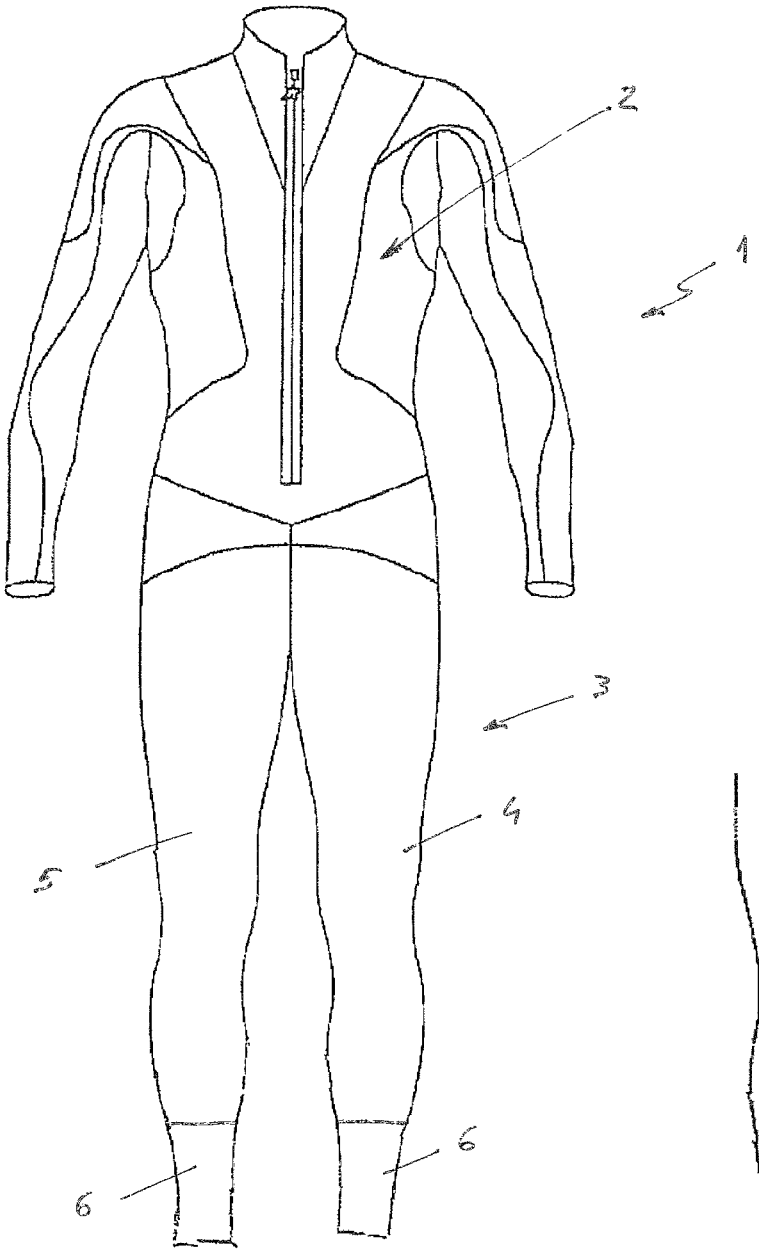
FIG. 1 is a front view of a cycling suit according to an embodiment of the invention.

Referring to FIG. 1, a cycling suit 1 comprises a top part 2 and a trousers portion 3 including two leg portions 4, 5.

The top part 2 and the trousers portion 3 are made at least partially of a first material, preferably a suitable elastic fabric material such as Lycra. In some embodiments, the top part 2 and/or the trousers portion 3 may include parts made of different materials or having different properties such as thickness or breathability.

Each of the leg portions 4, 5 terminates with a respective end section 6. Said end section 6 is made of a second material which is a water barrier material, having suitable properties to prevent water from travelling through the section 6. Preferably said second material is Neoprene or rubber or an equivalent.

The height H of the end section 6 from the lower end aperture 7 of the leg portion (FIG. 2) is preferably between 5 and 25 cm and more preferably between 10 and 20 cm.

The end section 6 is basically a tubular member going all around the ankle.

Figure 2:
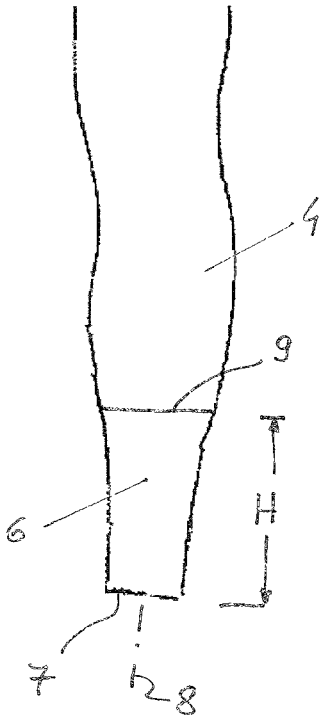
FIG. 2 shows the end of one of the leg portions of the cycling suit of FIG. 1.

FIGS. 1 and 2 show a first embodiment where the upper boundary line 9 of the water-barrier section 6 is substantially perpendicular to the longitudinal axis 8 of the leg portion. Accordingly, the section 6 can be regarded substantially as a cylindrical surface.

Said line 9 is the transition line from the material of the leg portion to the different material of the end section 6. Said line 9 may be a seam line made with a known technique such as stitching or welding for example.

Figure 3:
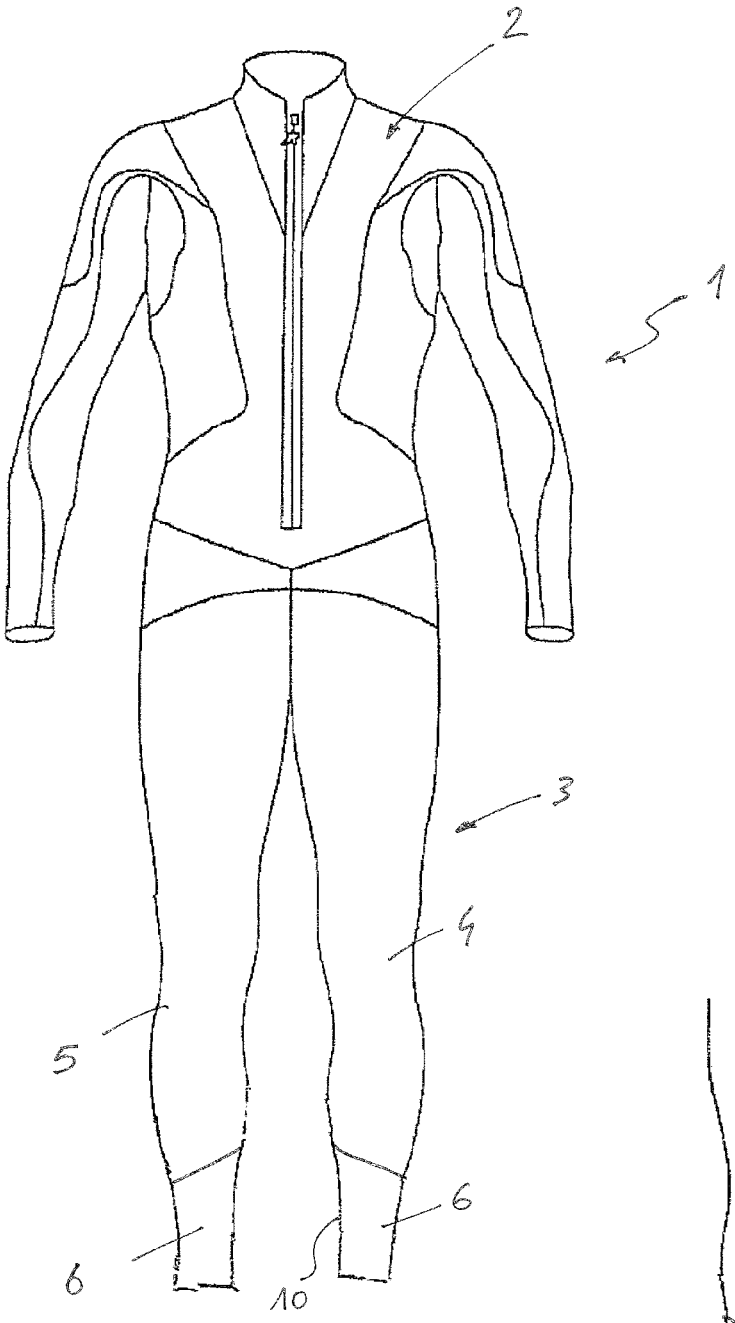
FIG. 3 is a front view of a cycling suit according to another embodiment of the invention.
Figure 4:
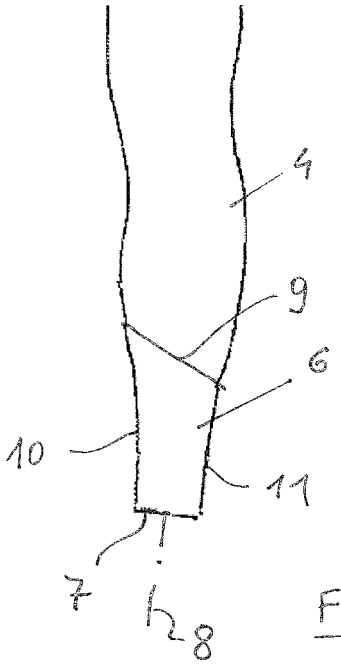
FIG. 4 shows the end of one of the leg portions of the cycling suit of FIG. 3.

FIGS. 3, 4 show another embodiment where the inner and outer sides of water-barrier section 6 have a different height and, as a consequence, the line 9 is tilted relative to the axis 8.

More preferably, the inner side 10 of the section 6 is higher than the outer side 11, as shown. The inner side 10 is more exposed to the water sprays from the road and generated the front wheel of the bike. Accordingly, the water-barrier end section 6 configured as in FIGS. 3 and 4, that is higher on the inner side 10, offers a better protection. The section 6, in this embodiment, can be regarded as a cylindrical segment cut by a plane inclined with reference to the axis 8, as illustrated in the FIG. 4.

The height of the section 6, on both sides 10, 11, is preferably within the above mentioned range of 5 to 25 cm and preferred range of 10 to 20 cm.

Figure 5:
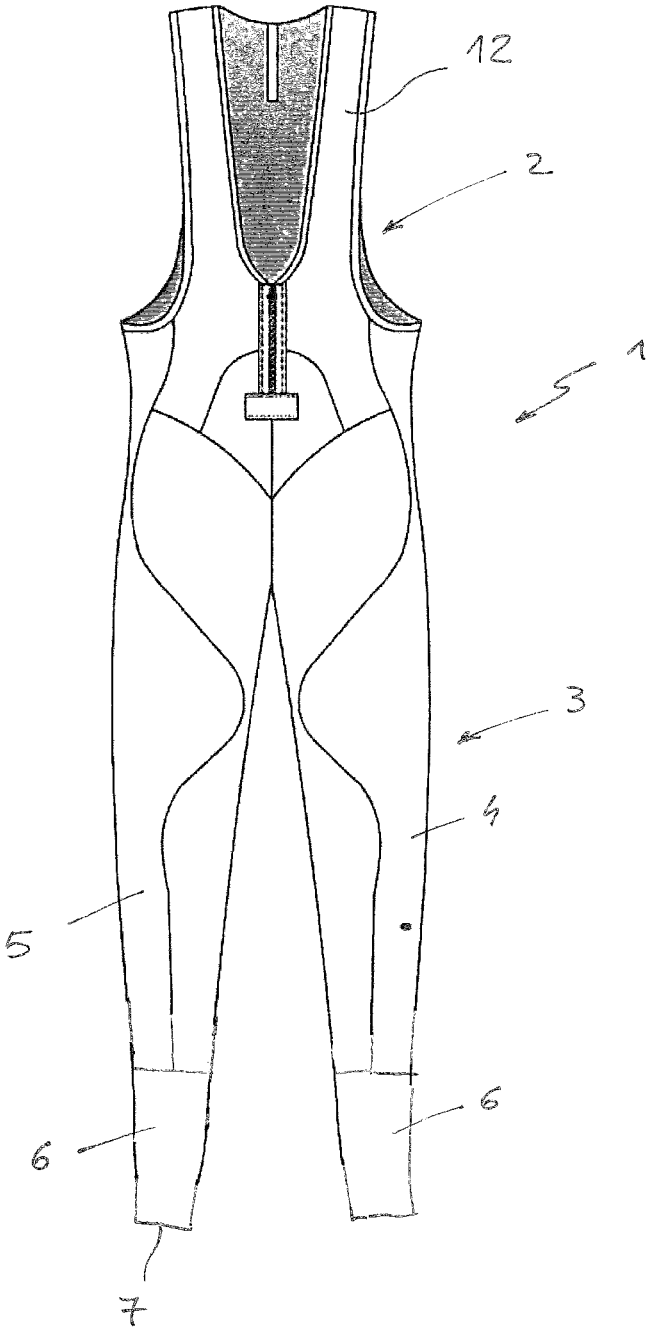
FIG. 5 illustrates another preferred embodiment of a cycling suit according to the invention.

In FIG. 1, the top part 2 is formed as an integral jacket. Various different embodiments, however, are possible within the present invention. FIG. 5 shows a particularly preferred embodiment of the cycling suit 1 where the top part comprises shoulder straps 12. Any embodiment of the top part 2 may be equally combined with any form of the transition line 9, in particular with those illustrated in FIGS. 1-2 or FIGS. 3-4.

In use, the end section 6 is inserted in a shoe or overshoes. The water barrier end section 6 stops water from penetrating in the shoes by flowing through the fibre of the suit; as a result, the comfort and performance in rainy weather is substantially improved.

The invention claimed is:

1. A cycling suit including at least a trousers portion forming a pair of trousers, wherein said trousers portion comprises leg portions and each leg portion includes a first portion which is made at least partially of a first material and a second portion, the second portion being a lower leg portion which forms an end section of the leg portion and terminates with a bottom aperture, wherein said first portion and said second portion are connected to each other at a a transition line, said second portion consisting of a second material other than said first material, and said second material being a water-barrier material, wherein the first material is an elastane fabric material, wherein the length of the second portion from the bottom aperture to the transition line, all around the leg portion, is in the range of 5 to 25 cm, said length being greater at an inner side of the leg portion than at an outer side of the same leg portion.

2. The suit according to claim 1, said second material being a water-proof rubber or synthetic rubber.

3. The suit according to claim 2, said second material being: polychloroprene, also referred to as Neoprene.

4. The suit according to claim 1, each one of said end sections having the shape of the surface of a cylinder.

5. The suit according to claim 1, each one of said end sections having the shape of a cylindrical segment, the upper part of said cylindrical segment being truncated by a plane of truncation which is inclined relative to the longitudinal axis of the respective leg portion.

6. The suit according to claim 1, comprising a top part integrally formed with the trousers portion.

7. A cycling suit including a trousers portion forming a pair of trousers and a top part integrally formed with the trousers portion, characterized in that said top part is formed as a jacket and said trousers portion comprises leg portions and each leg portion includes a first portion which is made at least partially of a first material and a second portion, the second portion being a lower leg portion which forms an end section of the leg portion and terminates with a bottom aperture, wherein said first portion and said second portion are connected to each other at a transition line, said second portion consisting of a second material other than said first material, and said second material being a water-barrier material, wherein the length of the second portion from the bottom aperture to the transition line, all around the leg portion, is in the range of 5 to 25 cm, said length being greater at an inner side of the leg portion than at an outer side of the same leg portion.

8. The cycling suit according to claim 7, wherein the first material is an elastane fabric material.

9. The cycling suit of claim 6, wherein the top part is a long-sleeved jacket.

10. The cycling suit of claim 7, wherein the top part is a long-sleeved jacket.

* * * * *